US008959763B2

(12) United States Patent
Wu

(10) Patent No.: US 8,959,763 B2
(45) Date of Patent: Feb. 24, 2015

(54) ELECTRICAL JACK CONNECTOR AND FABRICATION METHOD THEREOF

(75) Inventor: Yuanze Wu, Shenzhen (CN)

(73) Assignee: Yuanze Wu, Shenzhen (CN)

( * ) Notice: Subject to any disclaimer, the term of this patent is extended or adjusted under 35 U.S.C. 154(b) by 67 days.

(21) Appl. No.: 13/812,424

(22) PCT Filed: Aug. 24, 2010

(86) PCT No.: PCT/CN2010/076282

§ 371 (c)(1),
(2), (4) Date: Jan. 25, 2013

(87) PCT Pub. No.: WO2012/003654

PCT Pub. Date: Jan. 12, 2012

(65) Prior Publication Data

US 2013/0303036 A1 Nov. 14, 2013

(30) Foreign Application Priority Data

Jul. 6, 2010 (CN) ..... 2010 1 0220338

(51) Int. Cl.

| | |
|---|---|
| ***H01R 43/20*** | (2006.01) |
| ***H01R 13/18*** | (2006.01) |
| ***H01R 13/187*** | (2006.01) |
| ***H01R 43/16*** | (2006.01) |
| ***H01R 43/00*** | (2006.01) |

(52) U.S. Cl.

CPC ..... *H01R 13/18* (2013.01); *H01R 13/187* (2013.01); *H01R 43/16* (2013.01); *H01R 43/00* (2013.01)

USPC ..... 29/876; 439/843

(58) Field of Classification Search

CPC ..... H01R 13/187; H01R 4/4881

USPC ..... 439/843, 847, 851; 29/876

See application file for complete search history.

(56) References Cited

U.S. PATENT DOCUMENTS

| | | | | | |
|---|---|---|---|---|---|
| 3,023,789 | A | * | 3/1962 | Bonhomme | 140/93 R |
| 3,107,966 | A | * | 10/1963 | Bonhomme | 439/843 |
| 3,229,356 | A | * | 1/1966 | Bonhomme | 29/861 |
| 3,470,527 | A | * | 9/1969 | Bonhomme | 439/843 |
| 3,557,428 | A | * | 1/1971 | Bonhomme | 9/747 |
| 3,858,962 | A | * | 1/1975 | Bonhomme | 439/843 |
| 4,203,647 | A | * | 5/1980 | Bonhomme | 439/851 |
| 4,657,335 | A | * | 4/1987 | Koch et al. | 439/851 |
| 4,720,157 | A | * | 1/1988 | Nestor et al. | 439/851 |
| 4,734,063 | A | * | 3/1988 | Koch et al. | 439/844 |
| 5,115,563 | A | * | 5/1992 | Wilson | 29/876 |
| 5,203,813 | A | * | 4/1993 | Fitzsimmons et al. | 29/876 |
| 6,102,746 | A | * | 8/2000 | Nania et al. | 439/675 |

(Continued)

FOREIGN PATENT DOCUMENTS

| | | |
|---|---|---|
| CN | 1605138 | 4/2005 |
| CN | 1692530 | 11/2005 |
| DE | 19833675 | 2/2000 |

*Primary Examiner* — Ross Gushi

(74) *Attorney, Agent, or Firm* — Vidas, Arrett & Steinkraus

(57) ABSTRACT

An electrical jack connector and fabrication method thereof. The connector includes an resilient conductive leaf spring roll (1) which mates with a plug, a conductive inner sleeve (2) and a conductive outer sleeve (3) sleeved outside of the roll from inside to outside. Bending and protruding terminals of the resilient conductive leaf spring roll (1), which protrude out of two ends of the conductive inner sleeve (2), are fixedly clamped between a through-hole in the conductive outer sleeve (3) and the outside surface of the conductive inner sleeve (2).

4 Claims, 3 Drawing Sheets

(56) References Cited

U.S. PATENT DOCUMENTS

| | | | | |
|---|---|---|---|---|
| 6,536,107 | B1 | 3/2003 | Scholler et al. | |
| 6,752,668 | B2 * | 6/2004 | Koch, Jr. | 439/843 |
| 6,837,756 | B2 * | 1/2005 | Swearingen et al. | 439/843 |
| 6,848,922 | B2 * | 2/2005 | Coughlan et al. | 439/181 |
| 6,899,571 | B1 * | 5/2005 | Koch et al. | 439/843 |
| 7,048,596 | B2 * | 5/2006 | Swearingen et al. | 439/843 |
| 7,311,566 | B2 * | 12/2007 | Dent | 439/843 |
| 7,805,838 | B2 * | 10/2010 | Morana et al. | 29/868 |
| 7,828,609 | B2 * | 11/2010 | Li et al. | 439/843 |
| 7,857,671 | B2 * | 12/2010 | Carboni et al. | 439/824 |
| 2002/0049006 | A1 * | 4/2002 | Zhao et al. | 439/843 |
| 2003/0068931 | A1 * | 4/2003 | Swearingen et al. | 439/843 |
| 2003/0077950 | A1 * | 4/2003 | Swearingen et al. | 439/843 |
| 2004/0003498 | A1 * | 1/2004 | Swearingen et al. | 29/862 |
| 2004/0033732 | A1 * | 2/2004 | Koch, Jr. | 439/843 |
| 2005/0164566 | A1 * | 7/2005 | Zhao et al. | 439/851 |
| 2006/0217005 | A1 * | 9/2006 | Langhoff | 439/843 |
| 2009/0036003 | A1 * | 2/2009 | Morana et al. | 439/843 |
| 2009/0061700 | A1 * | 3/2009 | Coe et al. | 439/843 |
| 2009/0137158 | A1 * | 5/2009 | Carboni et al. | 439/660 |
| 2009/0298356 | A1 * | 12/2009 | Li et al. | 439/843 |
| 2010/0191299 | A1 * | 7/2010 | Ayzenberg | 607/2 |

* cited by examiner

ELECTRICAL JACK CONNECTOR AND FABRICATION METHOD THEREOF

CROSS-REFERENCE TO RELATED APPLICATIONS

This is a national stage application of PCT Application No. PCT/CN2010/076282, filed on Aug. 24, 2010, which claims the benefit of Chinese Patent Application No. 201010220338.X, Jul. 6, 2010, the entire contents of each are hereby incorporated herein by reference.

FIELD OF THE INVENTION

The present invention relates to an electrical connector, particularly to an electrical jack connector and the fabricating method thereof.

BACKGROUND OF THE INVENTION

The electrical connectors could also be called as connectors/sockets which are widely used in all kinds of electrical circuits for connecting or disconnecting the circuits and for enabling simplify the process of assembling these sockets or connectors to the electrical equipments that are to be electrically connected. Pin jack is a key component of electrical connector which directly affects the reliability of the electrical connector. The traditional contacting jack uses high-beryllium copper as the resilient leaf springs (strip shaped or vertical grids shaped), so that it has small contacting surface due to the structure, low conductivity and high heat generation due to the material, and the resilientity reduced with time.

SUMMARY OF THE INVENTION

A technical problem that the present invention needs to solve is to provide an electrical jack connector and the fabricating method thereof, so as to dramatically improve the performance and durability of the electrical connector.

The first technical problem of the present invention is solved by an electrical jack connector, comprising an resilient conductive leaf spring roll which mates with a plug, a conductive inner sleeve and a conductive outer sleeve both sleeved outside of the roll from inside to outside; wherein the bending and protruding terminals of the resilient conductive leaf spring roll which protrude out of two ends of the conductive inner sleeve are fixedly clamped between a through-hole in the conductive outer sleeve and the outside surface of the conductive inner sleeve.

According to the electrical jack connector provided by this present invention, the through-hole in the conductive outer sleeve has an interference fit with the conductive inner sleeve which sleeved into the through-hole and the protruding terminals. For example, the through-hole of the conductive outer sleeve and the outside surface of the conductive inner sleeve both are round-shaped, and the radius of the through-hole of the conductive outer sleeve is larger than the outer radius of the conductive inner sleeve but is smaller than the sum of the outer radius of the conductive inner sleeve and the thickness of the resilient leaf spring roll.

According to the electrical jack connector provided by the present invention, the axial length of the resilient conductive leaf spring roll is more than the axial length of the conductive inner sleeve and less than twice axial length of the conductive inner sleeve.

According to the electrical jack connector provided by the present invention, the part of the resilient conductive leaf spring roll within the conductive inner sleeve is distorted into a curve shape.

According to the electrical jack connector that provided by this present invention, the cross-section of the outer surface of the conductive outer sleeve is round, ellipse or rectangle in shape; the cross-sections of the through-hole of the conductive outer sleeve and the conductive inner sleeve both are the same in shape of round, ellipse or rectangle; the conductive leaf spring roll is grid leaf spring that rolled into the shape of round, ellipse or rectangle.

According to the electrical jack connector provided by the present invention, the outside surface of the conductive outer sleeve, the through-hole of the conductive outer sleeve and the through-hole of the conductive inner sleeve all have the same shape of cross section, or two of them have the same shape of cross section, or each of them have different shape of cross section.

According to the electrical jack connector provided by the present invention, the conductive outer sleeve has an inner lead angle.

According to the electrical jack connector provided by the present invention, the length of the conductive outer sleeve and the length of the through-hole in the conductive inner sleeve are substantially the same, or may be different.

According to the electrical jack connector provided by the present invention, the conductive leaf spring that forming the resilient conductive leaf spring roll has a width which is the same or substantially the same as the peripheral length of the cross section of the through-hole of the conductive inner sleeve.

According to the electrical jack connector provided by the present invention, the resilient conductive leaf spring roll is copper leaf spring roll; and the conductive outer sleeve and/or the conductive inner sleeve comprise surface electroplated layer.

Another technical problem of the present invention could be solved by a method for fabricating an electrical jack connector comprising the following steps:

forming a conductive inner sleeve, a conductive outer sleeve, an auxiliary outer sleeve and a resilient conductive leaf spring roll;

sleeving the resilient conductive leaf spring roll into the conductive inner sleeve;

expanding and deforming one protruding terminal of the roll within the conductive inner sleeve, and sleeving the terminal into the auxiliary sleeve by means of interference fit and then pressing the auxiliary sleeve onto the conductive inner sleeve;

expanding and deforming the other protruding terminal of the resilient conductive leaf spring roll within the conductive inner sleeve, and sleeving the other terminal into the conductive outer sleeve by means of interference fit, and then pressing the conductive outer sleeve onto the other protruding terminal and extruding the auxiliary sleeve out.

According to the method for fabricating an electrical jack connector provided by the present invention, forming a resilient conductive leaf spring roll comprises rolling up the stamping-formed grid leaf spring.

According to the method for fabricating an electrical jack connector provided by the present invention, pressing the conductive outer sleeve onto the conductive inner sleeve further comprises twisting the conductive outer sleeve to distort each leaf springs in the resilient conductive leaf spring roll.

According to the method for fabricating an electrical jack connector provided by the present invention, the auxiliary outer sleeve and the conductive outer sleeve have an inner lead angle to facilitate to press the conductive outer sleeve and the deformed protruding terminals of the resilient conductive leaf spring roll; the through-hole of the auxiliary outer sleeve and/or the a side of the part of the resilient conductive leaf spring roll corresponding to the auxiliary outer sleeve which contacting tightly to the through-hole of the auxiliary outer sleeve is coated with a layer of oil.

The electrical jack connector provided by the present invention uses resilient material with high conductivity and compact contacting structure, showing outstanding performance with low temperature rising, low voltage dropping and small size, and provides an extra large contact area, smooth & soft plugging-in and pulling-out force, normal and high-limit cohesion, and persistent resilientity that cooperated with pins so as to achieve the utter new performance of low temperature rising (the temperature rising is only 50% of the traditional contact parts), low voltage dropping, small size, large contact area, excellent cohesion, soft plugging-in and pulling-out force. It provides the new energy resource industry (solar energy, wind energy, electric vehicle and so on) with solutions of advanced and low energy consumption of contacting component. Furthermore, the conductive outer sleeve forms an integral part, which has the following advantages compared with the conductive outer sleeves that have two separated parts:

1. The electrical connector uses two conductive outer sleeves and press onto the conductive inner sleeve and the leaf spring with an interference fit, so that it would occur that the two conductive outer sleeves can not be aligned and thus they might be misaligned. The assembled electrical connector assembly can not fit well when fitting to the other electric component due to the misalignment of the two conductive outer sleeves. However, the electrical connector with one conductive outer sleeve would not have mismatch problem, and may fit well with other components.

2. The electrical connector with two conductive outer sleeves requires to be fit together by tools, so that there would possibly be some gap between them that may cause impedance when carrying high current; while the electrical connector with one conductive outer sleeve could carry the current smoothly.

3. The electrical connector with two conductive outer sleeves is discontinuous in the appearance, while an electrical connector with one conductive outer sleeve is formed as a integral part, so that it turns out very good-looking.

4. In an environment of vibration, the two conductive outer sleeves of the electrical connector with two conductive outer sleeves might be separated which will lead to sever safety problems, while there would be no such problems with the electrical connector with one conductive outer sleeve.

5. The electrical connector with two conductive outer sleeves causes longer time of processing due to adding a component and thus raises the cost, while the torsional spring with one outer sleeve reduces four components to three components and thus reduces the cost.

6. Because of the inherent defects of the product with two conductive outer sleeves, there would be gaps between the two outer sleeves so that water, humid air may penetrate into the jack, which would affect the electrical connecting, while there are no such problems with the product with one outer sleeve.

BRIEF DESCRIPTION OF THE DRAWINGS

The present invention is further described in detail combined with drawings and specific embodiments as follows.

DETAILED DESCRIPTION OF THE PRESENT INVENTION

Figure 5:
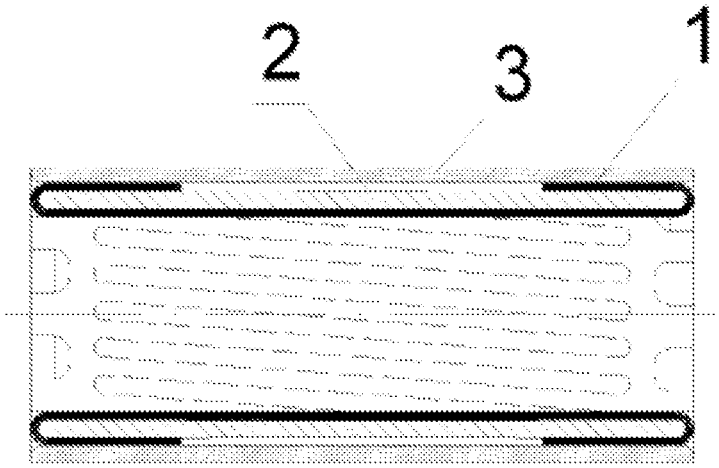
FIG. 5 shows the schematic diagram of the structure of the electrical connector of the present invention.

As shown in FIG. 5, one detailed embodiment of the electrical jack connector of the present invention comprises a resilient conductive leaf spring roll 1, a long cylindrical conductive inner sleeve 2 and a long cylindrical conductive outer sleeve 3, the cross section of the resilient conductive leaf spring roll 1, the long cylindrical conductive inner sleeve 2 and the long cylindrical conductive outer sleeve 3 all are rounded in shape.

Figure 1:
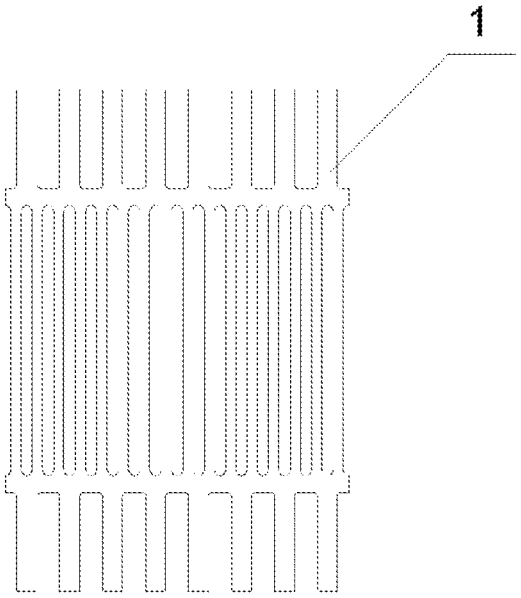
FIG. 1 shows the schematic diagram of the resilient conductive leaf spring used by the electrical jack connector of the present invention.
Figure 2:
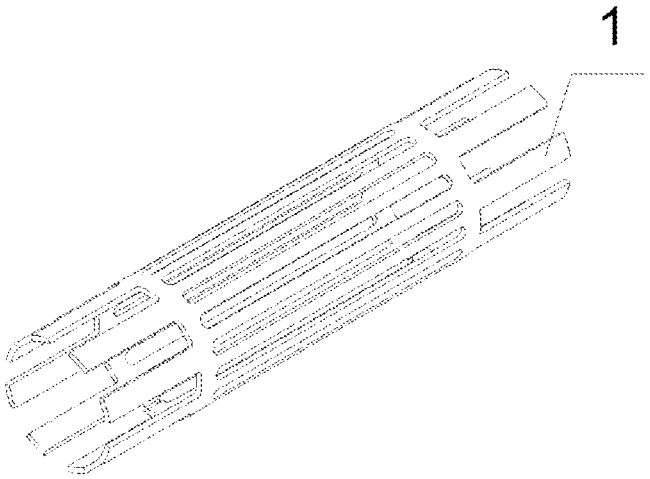
FIG. 2 shows the schematic diagram of the resilient conductive leaf spring roll made of the resilient conductive leaf spring shown in the FIG. 1.
Figure 3:
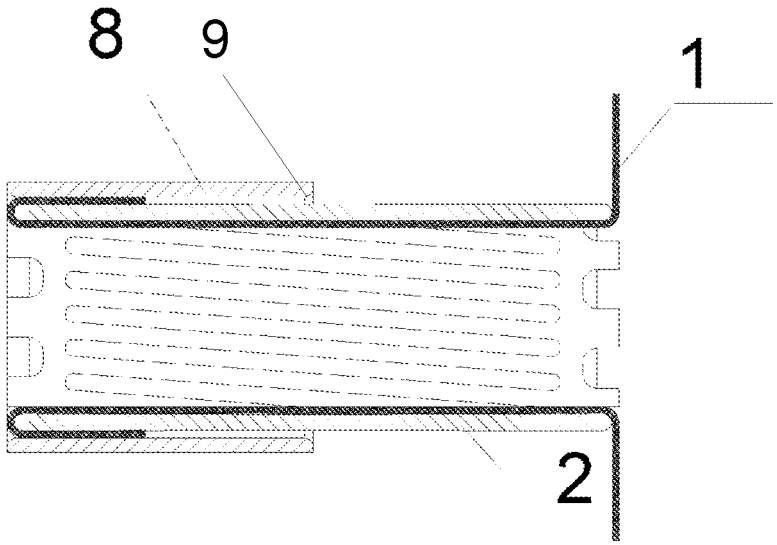
FIG. 3 shows the schematic diagram of the front view of the intermediate assembly of the electrical jack connector of the present invention.
Figure 4:
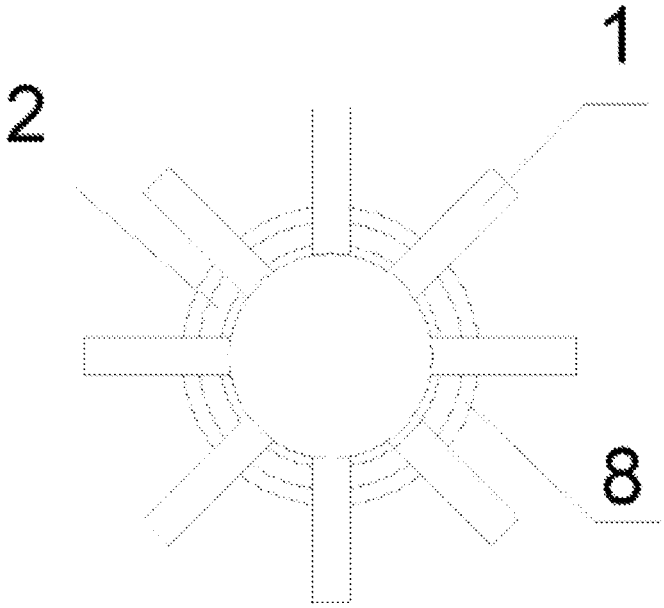
FIG. 4 is the schematic diagram of the right elevation of the assembly that shown in FIG. 3.

The detailed embodiment could be fabricated and assembled as the follows:

1. Using the stamping die to process copper strips into grid leaf springs, the shape of which being shown in FIG. 1;

2. Rolling the stamping-formed leaf springs into long cylindrical resilient conductive leaf spring roll 1 manually or by using tools, the shape of which being shown in FIG. 2;

3. Sleeving the resilient conductive leaf spring roll 1 into the conductive inner sleeve 2;

4. Manually or by using tools to expand and deform one protruding terminal of the roll 1 beyond the conductive inner sleeve 2, the process of expanding and deforming being shown in FIG. 4;

5. Putting the assembly of the conductive inner sleeve 2 and the resilient conductive leaf spring roll 1 together with the auxiliary outer sleeve 8 into manual drive press machine, and then sleeving the expanded and deformed terminal of the conductive leaf spring roll 1 into the auxiliary outer sleeve 8 by means of an interference fit, to form the assembly as shown in FIGS. 3 and 4;

6. Taking out and turn around the assembly and expanding and deforming the other one protruding terminal of the conductive leaf spring roll 1 as well, then putting it into the manual drive press machine together with the conductive outer sleeve 3, and using the manual drive press machine to sleeve the other protruding terminal of the conductive leaf spring roll 1 into the conductive outer sleeve 3 by means of an interference fit, and at the same time of pressing the conductive outer sleeve 3, twisting the conductive outer sleeve 3 to distort the leaf spring to some certain angle, and then pressing to just extrude the auxiliary outer sleeve 8 out and still sleeving the conductive outer sleeve 3 onto the other protruding terminal of the conductive leaf spring roll 1 at the end of the auxiliary outer sleeve 8;

7. Testing the pull-in and plug-out force, and excluding the defective products;

8. According to the demand of customer, applying surface plating treatment with gold, silver, tin or other materials.

The key points of the above-mentioned fabricating and assembling steps are: 1) to provide the auxiliary outer sleeve 8 and conductive outer sleeve 3 with an inner lead angle 9 to facilitate to press and sleeve the conductive outer sleeve and the protruding terminals of the resilient conductive leaf spring roll 1, 2) to provide a component at the corresponding extruding end for the conductive inner sleeve 2 and prevent the protruding ends of the resilient conductive leaf spring roll 1 from being extruded on the manual drive press machine, 3) to apply the inner surface of the through hole in the auxiliary outer sleeve 8 or the corresponding surface of the resilient conductive leaf spring roll 1 with oil or other treatment to make the friction between the resilient conductive leaf spring roll 1 and the auxiliary outer sleeve 8 less than the friction between the resilient conductive leaf spring roll 1 and the conductive inner sleeve 2, so as not to extrude the conductive leaf spring roll 1 while pressing in the conductive outer sleeve 3 and extruding the auxiliary outer sleeve 8 by means of an interference fit, and to use the conductive outer sleeve 3 replacing the auxiliary outer sleeve 8. These key points enable the integral conductive outer sleeve of the present invention.

EMBODIMENTS OF THE PRESENT INVENTION

At last, by using the electrical jack connector that provided by the present invention, the assembled product could be pressed into another component or sleeved into the other holes, meanwhile the conductive outer sleeve, the conductive inner sleeve and the through-holes in them could be of various shape, and the axial lengths of the conductive outer sleeve and the conductive inner sleeve could be different.

Although preferred embodiments of the present invention have been described, those of skill in the art will appreciate that variations and modifications may be made without departing from the spirit and scope thereof as defined by the appended claims.

THE INDUSTRY APPLICATION

The electrical jack connector of the present invention could be applied in the industry of new energy (solar energy, wind energy, electric vehicle and so on) and provides a solution for advanced and low energy consumption of contacting component. The fabricating method thereof provides a foundation for mass production of the electrical jack connector.

The invention claimed is:

1. A method for fabricating an electrical jack connector comprising the following steps:

preparing a conductive inner sleeve, a conductive outer sleeve, an auxiliary outer sleeve and a resilient conductive leaf spring roll;

sleeving the resilient conductive leaf spring roll into the conductive inner sleeve;

expanding and deforming one protruding terminal of the roll beyond the conductive inner sleeve, and sleeving the terminal into the auxiliary sleeve by means of interference fit and then pressing the auxiliary sleeve onto the conductive inner sleeve;

expanding and deforming the other protruding terminal of the resilient conductive leaf spring roll beyond the conductive inner sleeve, and sleeving the other terminal into the conductive outer sleeve by means of interference fit, and then pressing the conductive outer sleeve onto the other protruding terminal, wherein pressing the conductive outer sleeve further comprises twisting the conductive outer sleeve to distort each leaf spring in the resilient conductive leaf spring roll;

and extruding the auxiliary sleeve out.

2. A method for manufacturing an electrical jack connector as claimed in claim 1, wherein forming said conductive resilient leaf spring roll comprises rolling up the stamping-formed grid leaf spring.

3. A method for manufacturing an electrical jack connector as claimed in claim 1, wherein the auxiliary outer sleeve and the conductive outer sleeve have an inner lead angle to facilitate to press the conductive outer sleeve and the deformed protruding terminals of the resilient conductive leaf spring roll; the through-hole of the auxiliary outer sleeve and/or the a side of the part of the resilient conductive leaf spring roll corresponding to the auxiliary outer sleeve which contacting tightly to the through-hole of the auxiliary outer sleeve is coated with a layer of oil.

4. An electrical jack connector formed according to the method of claim 1.

* * * * *